United States Patent [19]

Murata

[11] 4,041,836

[45] Aug. 16, 1977

[54] OPEN CIRCUIT TYPE ACCELERATION/DECELERATION DEVICE

[76] Inventor: Hikaru Murata, No. 1734, Sakakura, Sakahogi-cho, Kamo, Gifu, Japan

[21] Appl. No.: 575,261

[22] Filed: May 7, 1975

[30] Foreign Application Priority Data

May 8, 1974 Japan ..... 49-51004
May 8, 1974 Japan ..... 49-51005

[51] Int. Cl.[2] ..... F15B 13/043

[52] U.S. Cl. ..... 91/29; 91/31; 137/110

[58] Field of Search ..... 91/6, 28, 29, 31; 137/110

[56] References Cited

U.S. PATENT DOCUMENTS

| | | | |
|---|---|---|---|
| 3,291,321 | 12/1966 | Hamilton | 91/31 X |
| 3,464,444 | 9/1969 | Tennis | 137/596.12 |
| 3,534,775 | 10/1970 | Tennis | 137/596.12 |
| 3,613,509 | 10/1971 | Flaschar et al. | 91/461 X |
| 3,739,690 | 6/1973 | Cryder | 91/28 |
| 3,884,253 | 5/1975 | Murata et al. | 137/110 |
| Re. 25,882 | 10/1965 | Bower | 91/31 |

*Primary Examiner*—Irwin C. Cohen
*Attorney, Agent, or Firm*—Saul Jecies

[57] ABSTRACT

An acceleration/deceleration device which, in order to achieve shockless acceleration/deceleration control in starting or stopping of the load by means of a hydraulic actuating circuit of the open circuit type, uses an amplification valve of a type such that the main flow rate may be amplified in proportion to the area ratio between a detection orifice installed in a pilot flow passage and a main orifice installed in the main flow passage and is constructed by combining the said amplification valve with a flow rate control valve for controlling the pilot flow and a control circuit for gradually changing the area of the opening of the main orifice.

7 Claims, 21 Drawing Figures

FIG. 4
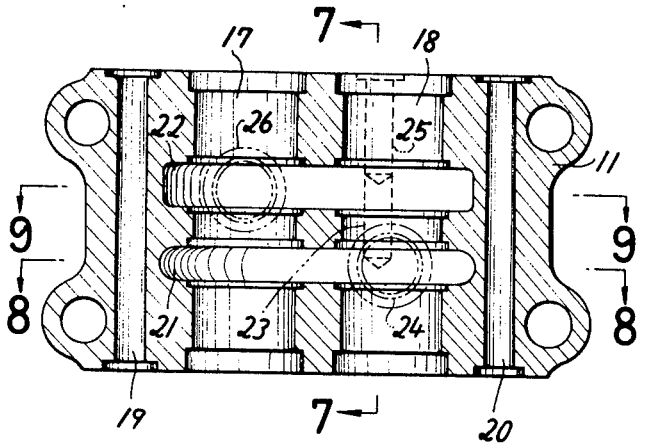
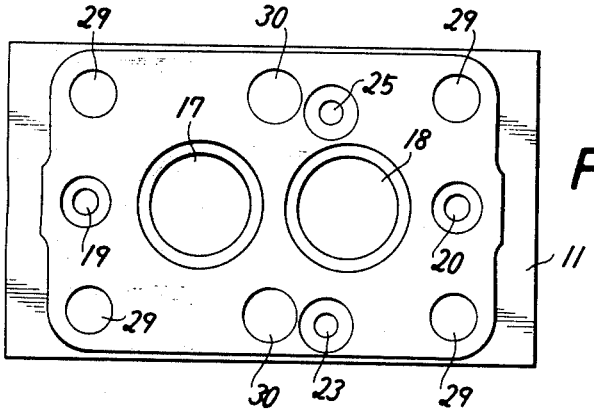
FIG. 5
FIG. 6
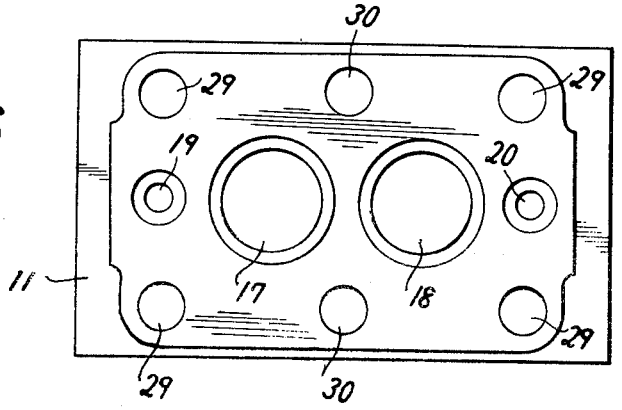

FIG.10
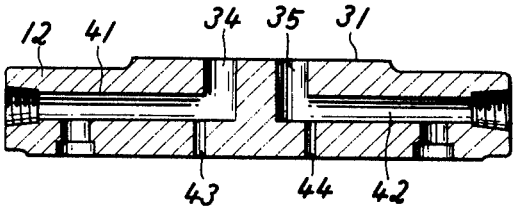
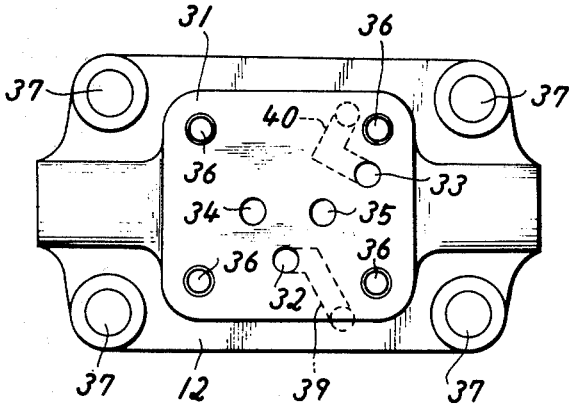
FIG.11
FIG.12
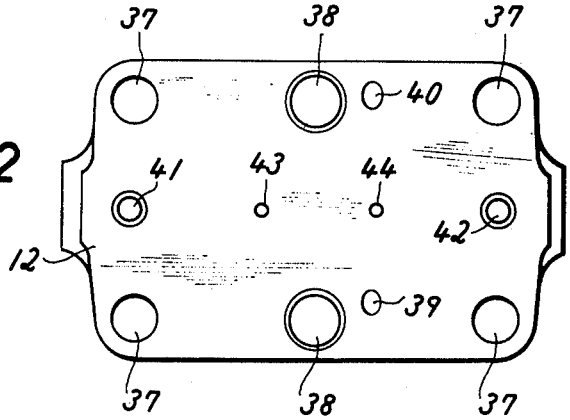
FIG.13
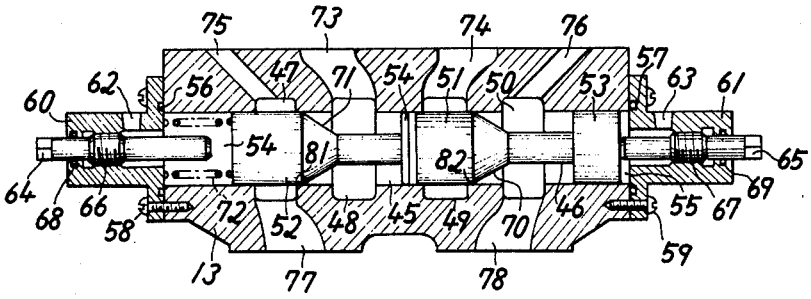

OPEN CIRCUIT TYPE ACCELERATION/DECELERATION DEVICE

BACKGROUND OF THE INVENTION

The present invention relates to an acceleration/deceleration device employed in hydraulic open circuit type actuating circuits and particularly to ones which are used for hydraulic actuating circuits that require an appropriate and shockless acceleration/deceleration control.

No matter whether it is rotary or linear motion, controlled shockless acceleration/deceleration of a load has been considered very difficult to achieve to date. In particular, the most common mechanisms tried so far for controlling large loads, or loads having large inertia have been designed so as to minimize shock occurring in starting or stopping the load by enabling the flow passage area to change in proportion to the stroke of the spool of a direction switching valve for pilot use installed in a pilot passage circuit of the amplification valve. In this case, the pilot flow valve rate in the circuit is controlled by adjusting the spool stroke so as to change the flow passage area of said amplification valve gradually and thus the main flow rate gradually increases or decreases in proportion to the said pilot flow rate. Still, this mechanism does not give satisfactory results. The reason is that since the control flow rate changes with supply pressure or load pressure because of throttle control mechanisms being used in the above cases, and unless the direction switching valve for pilot use is controlled very skillfully, a high pressure, is exerted on the actuator simultaneously with acceleration, or a high pressure is produced in the actuator simultaneously with deceleration as the return circuit is over-reduced, shock is imparted to the load. Even though the generation of such high pressure as mentioned above may be avoided by means of various compensatory adjusting mechanisms, the adjustment becomes complex and troublesome. In view of characteristics of throttle control, therefore, it will be difficult, without employing some other means, to achieve satisfactory control while maintaining an appropriate acceleration/deceleration curve. In this case, deviations occur from the acceleration/deceleration curve due to the changes in fluid temperature and pressure.

In cases where satisfactory control characteristics could not easily be obtained by simple means, closed circuits have been commonly adopted in the past, for both motor circuits and cylinder circuits, and variable capacity type pumps have also been adopted so that the delivery rate may be gradually increased during acceleration and may be gradually reduced by regenerative control methods or the like during deceleration, thus achieving smooth acceleration/deceleration control. According to the said mechanisms, it is feasible to prevent shocks from occurring during acceleration/deceleration only if attention is paid to the operation for changing the pump delivery rate during acceleration/deceleration of the load. The most noticeable defect of mechanisms incorporating such variable capacity type pumps, however, is that the pumps must respond each of the control objectives and that simultaneous operation cannot be achieved in parallel circuits for acceleration/deceleration control. In addition, if these circuits are different from each other in maximum velocity, it becomes very tedious work to control each of them by means of a pump section.

SUMMARY OF THE INVENTION

The purpose of the present invention, therefore, is to offer a unique acceleration/deceleration device of the kind not having such defects as mentioned above.

An additional purpose of the present invention is to offer an acceleration/deceleration device of the type having a particularly high deceleration efficiency.

To achieve these purposes in the present invention, an amplification valve of a type such that gives a main flow rate which is amplified, based on a pilot flow rate, in proportion to the area ratio of a main orifice incorporated in the main flow passage and a detection orifice incorporated in the pilot flow passage, employed in combination with a flow rate control valve for controlling the pilot valve and a control circuit for gradually changing the area of the main orifice opening so as to form an acceleration/deceleration device of the open circuit type. The acceleration/deceleration device of the present invention, therefore, makes it possible not only to achieve shockless acceleration/deceleration control for starting and stopping of a load since the amplification ratio of the main flow rate to the pilot flow rate in the amplification valve may be gradually reduced by changing the main orifice area linearly in the amplification valve through the control circuit, but also to achieve simultaneous operations in parallel circuits for acceleration/deceleration control purposes. Furthermore, it may be used in combination with other circuit specifications, thus giving a great flexibility to the control specification.

In addition, in the present invention, a means for reducing the pressure of the circuit which constitutes the supply side during the deceleration is incorporated in the said acceleration/deceleration device so as to intercept influences of the pressure from the supply side during the deceleration, and thus the deceleration efficiency being improved.

The abovementioned and other purposes, characteristics and performances of the present invention may be achieved as shown in the following descriptions of application examples which are made with reference to the drawings attached.

BRIEF DESCRIPTION OF THE DRAWINGS

FIG. 4 represents a longitudinal front section view showing the body part of the said amplification valve.

FIG. 5 represents a plan view of the same.

FIG. 6 represents a bottom plan view of the same.

FIG. 10 represents a longitudinal front section view showing the upper cover of the amplification valve.

FIG. 11 represents a plan view of the same.

FIG. 12 represents a bottom plan view of the same.

FIG. 13 represents a longitudinal front section view showing the lower cover of the amplification valve.

DESCRIPTION OF THE PREFERRED EMBODIMENT

Figure 1:
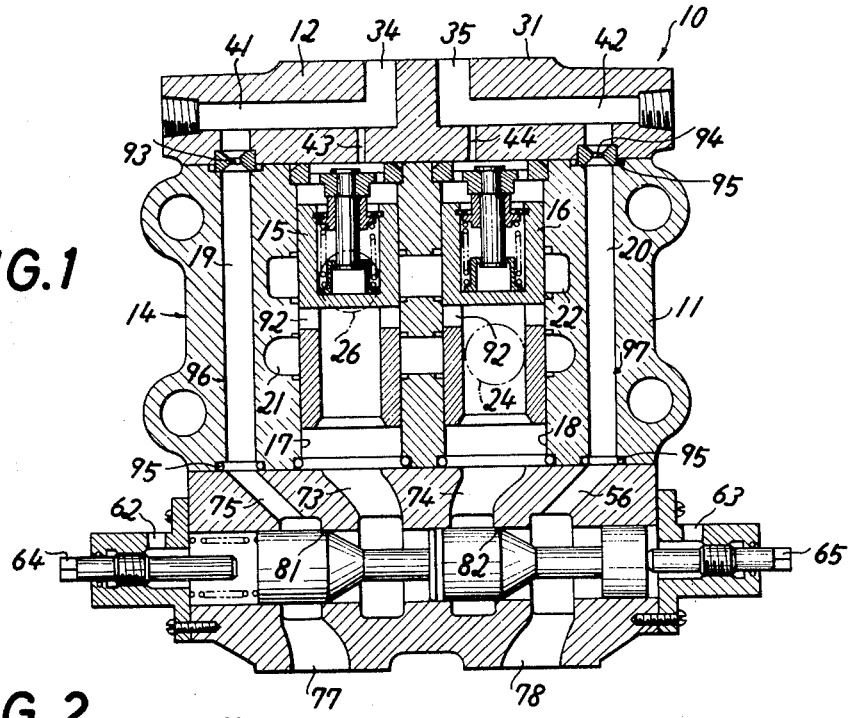
FIG. 1 represents a longitudinal front section view showing an application example of a amplification valve incorporated in an acceleration/deceleration device constructed according to the present invention.
Figure 2:
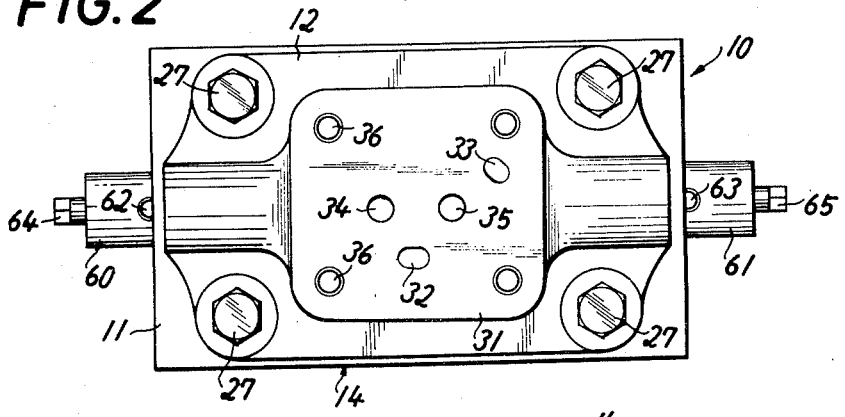
FIG. 2 represents a plan view of the same.
Figure 3:
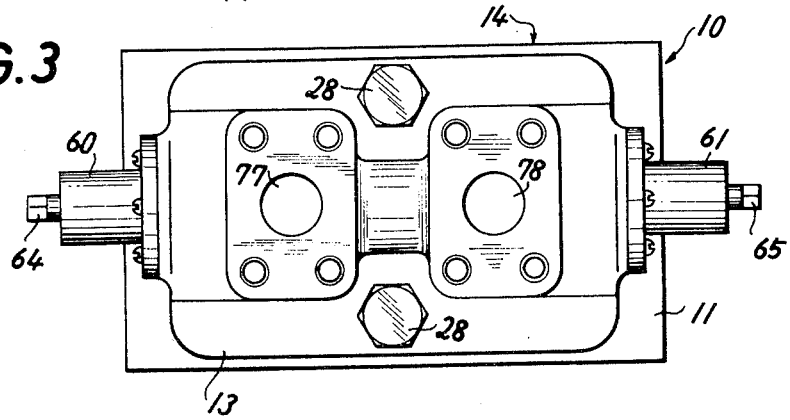
FIG. 3 represents a bottom plan view of the same.
Figure 7:
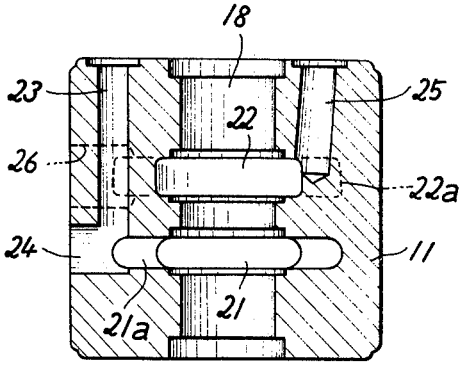
FIG. 7 represents a longitudinal side section view along the 7—7 line of FIG. 4.
Figure 8:
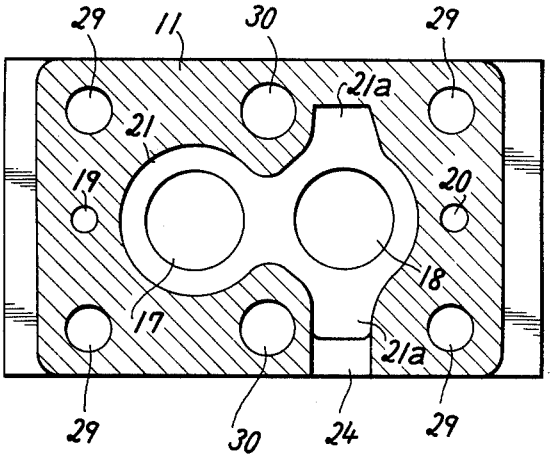
FIGS. 8 and 9 represent transverse sectional plan views along the 8—8 and 9—9 lines of FIG. 4, respectively.
Figure 9:
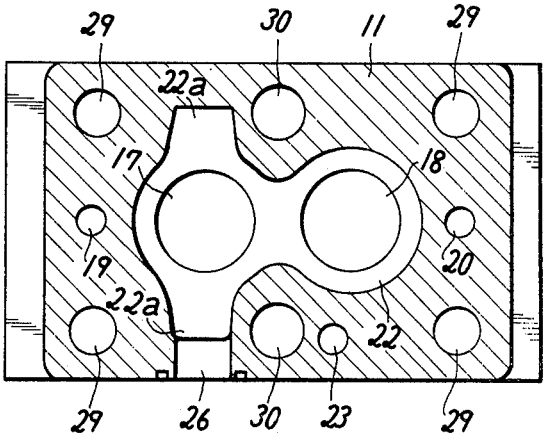

FIGS. 1 to 3 show an application pattern of an amplification valve 10 most appropriate for constructing the acceleration/deceleration device of the present invention. Namely, the amplification valve 10 comprises a valve body 14 consisting of the body 11 and upper and lower covers 12, 13 and valve spools 15, 16 incorporated in the said body 11.

As seen in FIGS. 4 to 9, the body 11 of the valve body 14 is provided with pairs of valve chambers 17, 18 and passages 19, 20 passing through the body longitudinally and in parallel, two annular grooves 21, 22 formed around both the said valve chambers 17, 18, a canal 23 and outer port 24 connecting to one 21 of the annular grooves and a channel 25 and outer port 26 connecting to the other annular groove 22, where the channels 23, 25 are open to the upper surface of the body part 11 and the outer ports 24, 26 are open to the outside surface of the body part 11. In this case, in order to facilitate the boring of channels 23, 25 and outer ports 24, 26 extended parts 21*a*, 22*a* are formed by extending the opposite walls of each the said annular grooves 21, 22 to the front and rear. The outer ports 24, 26 are bored from the outside surface of the body 11 towards these expanded parts 21*a*, 22*a*. Channel 23 is bored from the upper surface of the body 11 towards extended part 21*a* of the annular groove 21, avoiding the upper annular groove 22 by means of to its curved section and channel 25 is bored somewhat diagonally towards the curved section of the upper annular groove 22. In addition, through holes 29, 30 are bored longitudinally through the body 11, so that through bolts 27, 28 (See FIGS. 2 to 3) may be inserted for fixing the upper and lower covers 12, 13 respectively to the body.

As seen in FIGS. 10 to 12, the cover 12 fixed to the top of the body 11 is provided with a valve seat 31 at its upper surface. A supply port 32 and discharge port 33 for pilot use, two pilot ports 34, 35 and screw holes 36 for attaching a pilot valve are open in the position of the said valve seat 31 in alignment with each passage and attachment hole of a standardized solenoid valve. In addition, attachment holes 37 and screw holes 38 are bored in the periphery of cover 12 in alignment with the said through holes 29, 30 of the body 11. The supply port 32 and discharge port 33 and the pilot ports 34, 35 are led to specified positions at the lower surface of the cover 12 through passages 39, 40 bored diagonally in cover 12 from its upper and lower surfaces and through L-type passages 41, 42, respectively, so that the supply port 32, discharge port 33 and two pilot ports 34, 35 may be connected to channels 23, 25 and passages 19, 20 of the said body 11 side when the cover 12 is attached to the top of the body 11. In addition, damper orifices 43, 44 branch at passages 41, 42 leading to pilot ports 34, 35 so as to be connected to the upper ports of valve chambers 17, 18 of body port 1 side, respectively.

Figure 14:
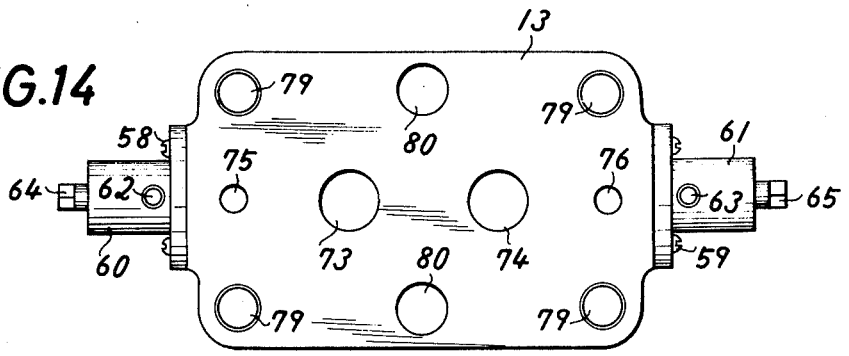
FIG. 14 represents a plan view of the same.
Figure 15:
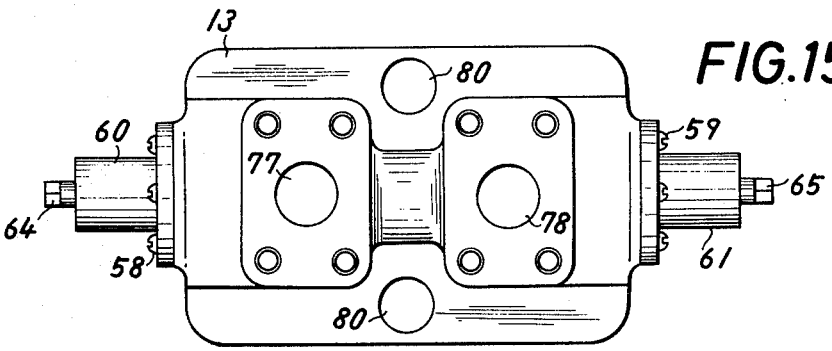
FIG. 15 represents a bottom plan view of the same.

As seen in FIGS. 13 to 15, the other cover 13 for closing the bottom of the body 11 is provided with a valve hole 45 penetrating in the lateral direction and a freely sliding valve spool 46 incorporated in valve hole 45. The said valve hold 45 is provided with four annular grooves 47, 48, 49, 50 in its inner circumference, while valve spool 46 is provided with three 51, 52, 53 at both ends and its center, which contact the inner walls of tne valve hole 45 during sliding. The central land 51 of said valve spool 16 always prevents the connection of annular grooves 48, 49 in the valve hole 45 by means of a seal 54 fitted to the outer circumference, while the left and right lands 52, 53 form two chambers 54, 55 at both ends of the valve hole 45, being isolated from annular grooves 47, 50. These chambers 54, 55 are covered with caps 60, 61, which are attached to both side walls of the cover 13 by means of screws 58, 59 using seals 56, 57, and are open to the outside through ports 62, 63 bored in these cap 60, 61. Furthermore, the caps 60, 61 have topper rods 64, 65, respectively, inserted through them in such a manner that they may be driven freely by means of screws 66, 67. Seals 68, 69 are placed between the stopper rods 64, 65 and the caps 60, 61 so as to make these parts fit tightly.

The right end of the central and left lands 51, 52 of the said valve spool 46 forms tapers 70, 71, which have a slope corresponding to that of the acceleration/deceleration control curve. The valve spool 46 is pressed to the right by a spring 72 placed between its left end and the left cap body 60 and is stopped at its right end by contact with the right stopper rod 65, so that the fluid passage area formed between the said tapered parts 70, 71 and the annular grooves 47, 49 may be kept at a minimum. On the other hand, when, due to a difference occurring between the hydraulic pressures exerted on chambers 54, 55 through ports 62, 63, the valve spool 46 moves to the left while pressing the spring 72 and stops when its left end comes in contact with the left stopper rod 64, the fluid passage area formed between the said tapered parts 70, 71 and the annular groove 47, 49 is kept at a maximum. It will be realized, therefore, that the maximum and the minimum fluid passage areas formed between the tapered parts 70, 71 of the valve spool 46 and the annular grooves 47, 49 of the valve hole 45 side are controlled by the left and the right stopper rods 64, 65, respectively.

Furthermore, the said cover 13 is provided with two passages 73, 74 leading from its upper surface to annular grooves 48, 49 of the valve hole 45, two passages 75, 76 leading in the same manner to annular grooves 47, 50 two outer ports 77, 78 leading to the annular grooves 47, 50 from the lower surface and screw holes 79 and attachment holes 80 bored in aligument with the through holes 29, 30 of the body 11 side, so that the passages 73, 74 and the passages 75, 76 can be connected to the lower part of valve chambers 17, 18 of the body 11 and passages 19, 20, respectively, when cover 13 is fixed to the bottom of the body 11 by means of these screw holes 79 and attachment holes 80. Thus, the fluid passage area formed between the said tapered parts 70, 71 of the valve spool 46 and the annular grooves 47, 49 of the valve hold 45 makes main orifices 81, 82 variable so that their opening area may be changed by the valve spool 46 moving against the fluid flowing between the valve chambers 17, 18 of the body part 11 and the outer ports 77, 78 of the cover 13.

Figure 16:
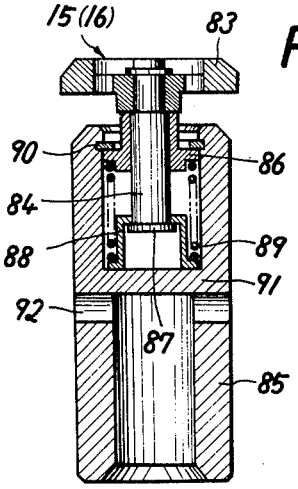
FIG. 16 represents a longitudinal front section view showing a valve spool to be incorporated in the body part of the amplification valve.

Next, as seen in FIG. 16, valve spools 15, 16 which are to be placed in valve chambers 17, 18 of the body 11 are provided with the bush 83 in their upper parts. A guide rod 84 extending from the bush is inserted into a spool 85, and a center spring 89 is placed between a spring holder 86 which is placed at the base of the said guide rod 84 and another spring holder 88 which is placed at the top end and end fastened by means of a rim 87. Thus, the bush 83 and the spool 85 are normally kept in specified relative positions by keeping the said spring holder 86 in contact with a snap ring 90 fitted to the spool 85 side and the bottom end of the other spring holder 88 in contact with a partition wall 91 formed in spool 85. In addition, a through hole 92 is bored under the partition wall 91 penetrating the side walls of the said spool 85.

As seen in FIGS. 1 to 3, therefore, when valve spools 15, 16 are incorporated in valve chambers 17, 18 of the said body 11, and when detection orifices 93, 94 are incorporated in passages 41, 42 of the upper cover 12 and when upper and the lower covers 12, 13 are attached to the body part 11, while inserting packings 95 as required, and locking the unit as one body with through bolts 27, 28 by means of through holes 29, 30, attaching holes 37, 80 and screw holes 38, 79, passages 73, 74 of the lower cover 13 will be connected to the lower part of valve chambers 17, 18 of the body 11 and the damper orifices 43, 44 branching from passage 41, 42 of the upper cover 12 will be connected to the upper part of valve chambers 17, 18, while pilot ports 34, 35 of the upper cover 12 and outer ports 77, 78 of the lower cover 13 will be connected to each other through pilot passages 96, 97 consisting of passages 75, 19, 41 and passages 76, 20, 42, respectively. At the same time, outer port 24 of the body 11 will be connected from the lower annular groove 21 to the supply port 32 of the upper cover 12 through passages 23, 39 and the other outer port 26 will be connected from the upper annular groove 22 to a discharge port 33 through passages 25, 40. While the conditions exists that the through hole 92 is located between annular grooves 21, 22 as seen in FIG. 1, valve spools 15, 16 placed in valve chambers 17, 18 of the said body 11 maintain a neutral position without connecting either of the annular grooves.

The construction of the amplification valve 10 to be employed for the acceleration/deceleration devices of the present invention may be achieved according to the explanation given above. Further explanation of an acceleration/deceleration device constructed according to the present invention will be made, therefore, incorporating the said amplification valve 10.

Figure 17:
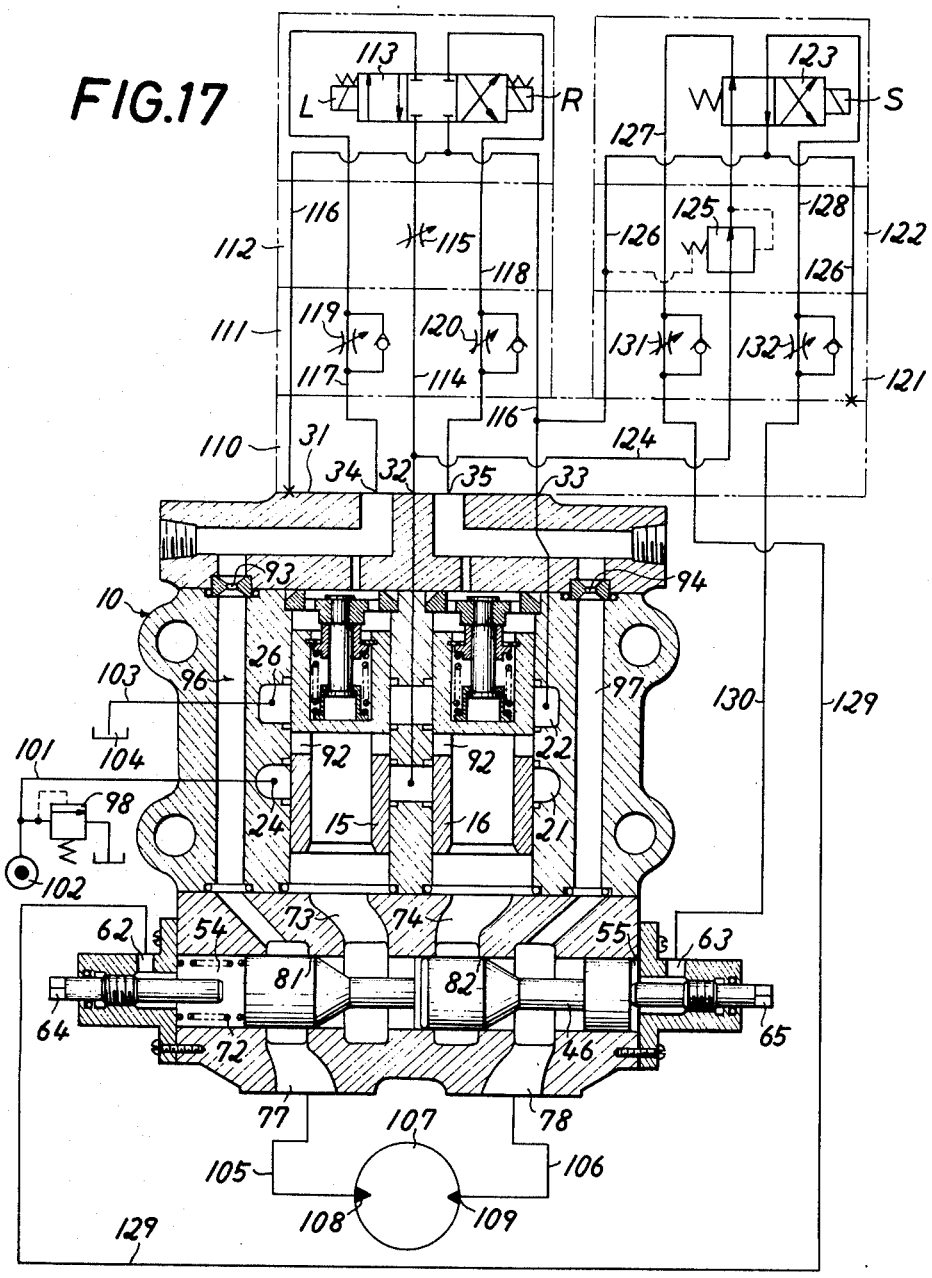
FIG. 17 represents a circuit diagram showing an application pattern of the acceleration/deceleration device described in the present invention which is equipped with the said amplification valve.

FIG. 17 shows an acceleration/deceleration device of the open circuit type constructed according to the present invention incorporating the said amplification valve 10. Namely, an outer port 24 at the side of the amplification valve 10 is connected to a hydraulic source 102 such as a pump, through a duct 101 and the other outer port 26 is connected in the same manner to a reservoir 104, such as a tank, through a duct 103, while the two outer ports 77, 78 of the lower surface are connected to ports 108, 109 of an actuator 107 such as a motor, through ducts 105, 106, respectively.

At the upper surface of the amplification valve 10, a manifold plate 110, valve assemblies 111, 112 for adjusting the flow rate and a closed-center 4-port 3-position solenoid valve 113 are placed in layers on the valve seat 31 using its screw holes 36. Thus, the supply port 32, the discharge port 33 and the pilot ports 34, 35 are connected to each port of the solenoid valve 113 through a passage 114 and a flow rate adjusting valve 115 for meter-in use, through a passage 116 and through passages 117, 118 and flow rate adjusting valves 119, 120 for meter-out use, respectively, as shown in the figure, to form a circuit module for controlling the direction and velocity of flow.

Furthermore, in parallel to the abovementioned circuit module for controlling the direction and velocity, a valve assembly 121 for controlling the flow rate, a valve assembly 122 for controlling the pressure and a 4-port 2-position solenoid valve 123 are placed in layers on the said manifold plate 110. Thus, the said passage 114 leading to the supply port 32 of the amplification valve 10 and the said passage 116 leading to the discharge port 33 are connected to the two ports of the solenoid valve 123 through a passage 124 and pressure-reducing valve 125 and through a passage 126, respectively, as shown in the figure, while the remaining two ports of the solenoid valve 123 are connected to the left and right ports 62, 63 of the lower cover 13 of the amplification valve 10 through passages 127, 128, ducts 129, 130 and flow rate adjusting valves 131, 132 for meter-out use, respectively, to form a circuit module for controlling the opening area of main orifices 81, 82 of the amplification valve 10.

Thus, as long as the solenoid valves 113, 123 are inactivated as shown in FIG. 17, no fluid flows in the circuit and the actuator 107 does not run. The reason is that the hydraulic actuating fluid sent from a hydraulic source 102 to annular groove 21 through outer port 24 in the amplification valve 10 is held in annular groove 21 by valve spools 15, 16, that supply port 32 for pilot use leading to the annular groove 21 is stopped at solenoid valve 113, and that the hydraulic actuating fluid flow from the said supply port 32 to a chamber 54 through passage 124, solenoid valve 123, passage 127, duct 129 and port 62 is stopped without any fluid movement in the circuit occurring as spool 46 is in contact with the stopper rod 65 at the right end and is not allowed to proceed further to the right.

Now, in order to cause the actuator 107 to start normal revolution, the solenoid valve is first switched over to the left position for normal revolution use by activating its left side solenoid L. Then, pilot flows of the actuating fluid will occur at both the supply and the discharge sides. In this case, the pilot flow of the supply side proceeds from a hydraulic source 102 to port 108 of the actuator 107 through duct 101 — outer port 24 of the amplification valve 10 — annular groove 21 — supply port 32 — passage 114 — solenoid valve 113 — passage 117 — pilot port 34 — pilot passage 96 — outer port 77 — duct 105, while the pilot flow of discharge side returns from a port 109 of the actuator 107 to a reservoir 104 through duct 106 — outer port 78 — pilot passage 97 — pilot port 35 — passage 118 — solenoid valve 113 — passage 116 — discharge port 33 — annular groove 22 — outer port 26 — duct 103, and thus actuator 107 starts normal revolution.

At this stage, however, the solenoid valve 123 still remains in the condition shown in FIG. 17, where the valve spool 46 forming main orifices 81, 82 is in the extreme right side position as shown in the figure. In this case, therefore, if the right side stopper rod 65 is in the position to make the opening area of the main orifices 81, 82 zero, valve spool 46 will be prevented from moving to the right and no hydraulic actuating fluid other than the said pilot flow will be supplied to the actuator 107. On the other hand, if the right side stopper rod 65 is adjusted beforeheand so as to create the proper opening area in main orifices 81, 82, a differential pressure will be produced by the occurrence of the said pilot flow based on the pilot flow rate between the position in front of and behind detection orifices 93, 94 incorporated in pilot passages 96, 97. Due to this differential pressure, the left side valve spool 15 will move downwards pressing spring 89, and the right side valve spool 16 will move upwards pressing spring 89. As a result, main flows of the hydraulic actuating fluid will occur on both the supply and the discharge side, where the former proceeds from the annular groove 21 to port 108 of the actuator 107 — through hole 92 of the valve spool 15 — passage 73 — main orifice 81 — outer port 77 while merging with the said pilot flow of the supply side and the latter proceeds from port 109 of the actuator 107 to reservoir 104 through outer port 78 — main orifice — 82 — passage 74 — through hole 92 of the valve spool 16 — annular groove 22 — outer port 26 while merging with the said pilot flow of the discharge side. As these main flows occur on the supply and the discharge sides, differential pressures will be produced according to their flow rates between positions in front of and behind main orifices 81, 82 and these differential pressures act to resolve the differential pressure caused by the said pilot flow between the positions in front of and behind detection orifices 93, 94. As a result, valve spools 15, 16 stop in a position such that the difference between differential pressures at the detection orifices 93, 94 caused by the pilot flow and at the main orifices 81, 82 caused by the main flow become balanced by the restoring force of the spring 89. In this case, the flow rate Q of the main flow may be given by the well known equation $Q = (A/a).q$, where $q$ stands for the flow rate of the pilot flow, a for the opening area of the detection orifices 93, 94, and A for the opening area of the main orifices 81, 82. It will be realized, therefore, that the amplification ratio of the main flow rate in relation to the pilot flow rate may be selected freely by adjusting the opening area of the main orifices 81, 82 by means of the said right side stopper rod 65.

Generally speaking, it is common control practice to keep the pilot flow very small compared with the maximum main flow rate. In this application example also, a flow rate adusting valve 115 is installed in the meter-in direction in the supply side pilot flow so as to minimize the pilot flow rate. Thus, the pilot flow occurring at the initial stage of starting the said actuator 107 delivers little shock to the load due to the cushioning effect of the passage capacity behind the solenoid valve 113. When the cushioning effect is great, the supply flow rate of the pilot flow may be increased to some extent from the start by the addition of a specified main flow rate by manipulating the right side stopper rod 65 so as to provide the proper opening area of the main orifices 81, 82.

Following the said acceleration initial stage, a solenoid valve 123 in the control circuit is switched over to the right side position by activating its solenoid S. Then, the hydraulic actuating fluid will be led from the supply port 32 of the amplification valve 10 to a chamber 55 through passage 124 — pressure reducing valve125 — solenoid valve 123 — passage 128 — duct 130 — port 63, while the opposite chamber 54 will be connected to the reservoir 104 side through port 62 — duct 129 — passage 127 — flow rate adjusting valve 131 for meter-in use — solenoid valve 123 — passage 126 — discharge port 33. As a result, valve spool 46 moves to the left pressing spring 72 to enlarge the opening area of main orifices 81, 82 gradually. Thus, with an increasing amplification ratio of the main flow rate in relation to the pilot flow rate, the supply flow rate to the actuator 107 will increase, and accelerate the actuator. Now, if the control flow rate of the flow rate adjusting valve 131 in the said control circuit is adjusted properly by controlling the valve spool 46 travelling speed to the left so as to give a specified acceleration curve, the actuator 107 may be accelerated to its maximum speed giving an acceleration condition most favorable for shockless performance.

Deceleration control is carried out in the exact reverse order of the abovementioned process. Namely, under the condition that control is carried out with actuator 107 at maximum revolutions, the solenoid valve 123 in the control circuit is first switched over to the left side position by inactivating its solenoid S. Then, the hydraulic actuating fluid is led from the supply port 32 to chamber 54 through passage 124 — pressure reducing valve 125 — solenoid valve 123 — passage 127 — duct 129 — port 62, while the opposite chamber 55 is connected to the reservoir 104 side through port 63 — duct 130 — passage 128 — flow rate adjusting valve 132 for meter-out control use — solenoid valve 123 — passage 126 — discharge port 33, so that valve spool 46 moves to the right to reduce the opening area of the main orifices 81, 82 gradually, and eventually to reduce the amplification ratio of the main flow in relation to the pilot flow. In this case, the valve spool 46 travelling speed to the right is controlled by adjusting flow rate adusting valve 132 installed in the return side of the control circuit. Upon starting the said deceleration process, the flow rate adjusting valve 120 for meter-out control use installed in the path of the pilot flow of the return side acts to limit the pilot flow rate in this side to a certain level. The flow of the discharge side from the actuator 107, therefore, reduces the amplification ratio of the main flow with the gradually reducing opening area of main orifices 81, 82 corresponding to the valve spool 46 travelling speed to the right which is controlled by adjusting the said flow rate adjusting valve 132. Thus, actuator 107 is decelerated without shock under the meter-out control according to the deceleration curve set by adjusting flow rate adjusting valve 120 so that the flow rate reaches the lowest velocity. Then, as solenoid L of solenoid valve 113 is inactivated and brought back to the neutral position, the pilot flow becomes zero and actuator 107 stops.

The above explanation was based on the control process for acceleration and deceleration of the actuator 107 under the condition that it was driven in the normal revolution direction. In the case where actuator 107 is driven in the reverse revolution direction, the control process may be practiced in a similar manner by activating or inactivating solenoid R at the right side of the solenoid valve 113 so as to effect a switching process between the central position and the right side position.

In this case, however, the direction of switching process and the direction of the pilot flow in the velocity control circuits as well as the direction of movement of valve spools 15, 16 of amplification valve 10, and eventually the direction of the main flow, will be reversed. Other control processes during acceleration and deceleration are same as in the case of the abovementioned normal revolution and may be understood easily without any further explanation.

Figure 18:
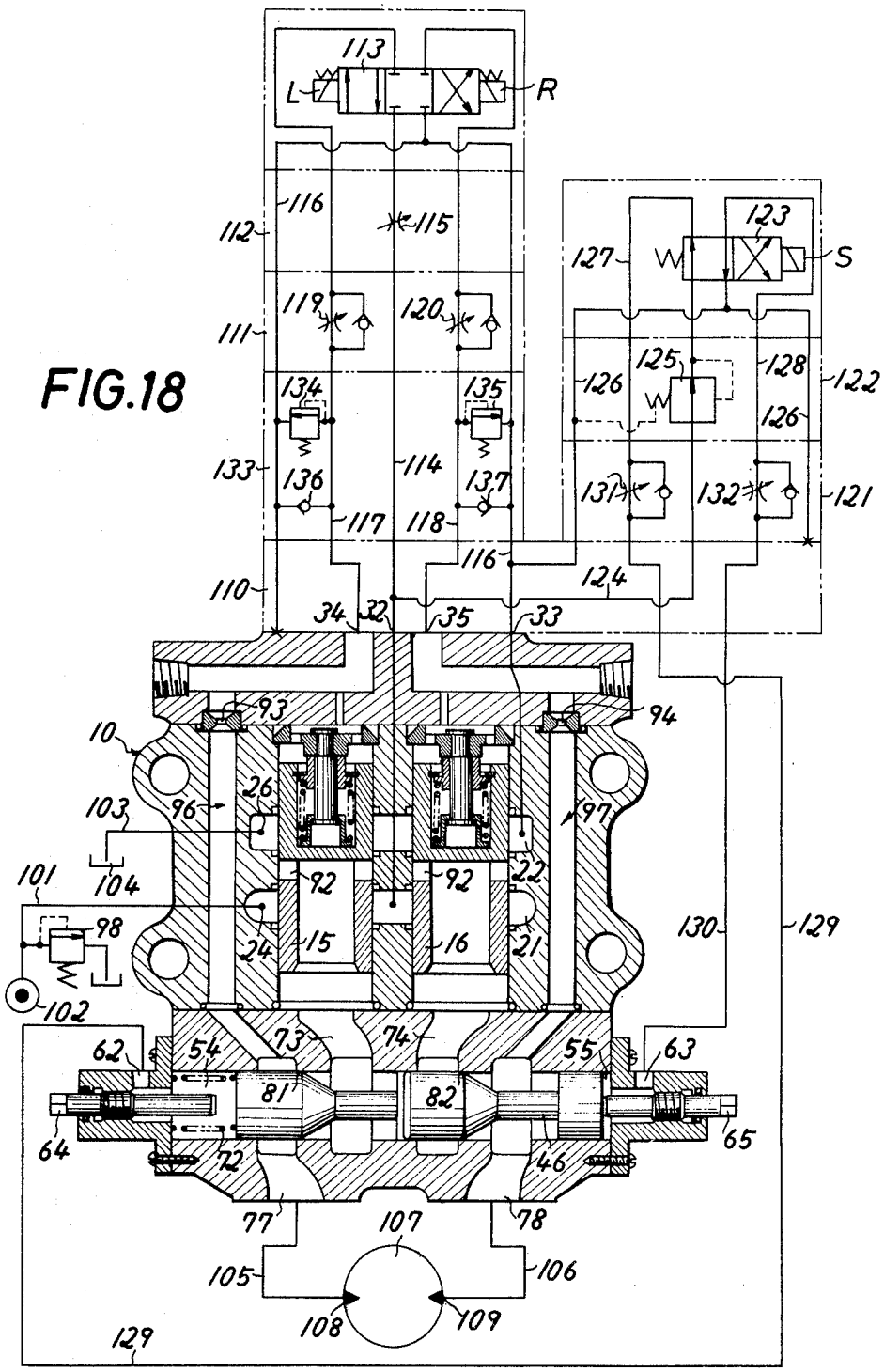
FIG. 18 represents a circuit diagram where an overload prevention function is incorporated in the acceleration/deceleration device of FIG. 17.

Next, the application example shown in FIG. 18 differs from the application example of FIG. 17 only in that an over-load relief use valve assembly 133 is added between manifold plate 110 and valve assembly 111 for use as the flow rate adjusting valve. Namely, passages 117, 118 leading to pilot ports 34, 35 of the amplification valve 10 are connected to passage 116 leading to a discharge port 33 through over-load relief valves 134, 135, while anti-cavitation valves 136, 137 are arranged so as to allow the hydraulic actuating fluid to flow in reverse from passage 116 towards passages 117, 118. Although the control process fundamentally quite the same as that in the abovementioned application example of FIG. 17, the pilot flow is returned from these over-load relief valves 134, 135 to the reservoir 104 side during acceleration, particularly if the acceleration/deceleration torque in parallel circuits is lower than a value set by the main relief valve 98, so that the pressure of the supply side hydraulic actuating fluid behind the flow rate adjusting valve 115 for meter-in control use installed in passage 114 leading to supply port 32 may be controlled by these over-load valves 134, 135, thus ensuring stabilized acceleration.

In addition, typical examples of various control characteristics as produced by varying the condition of each part in the acceleration/deceleration devices of FIGS. 17 and 18 are given in Tables 1 and 2.

Table 2

| Conditions of the Acceleration/Deceleration Control | | |
|---|---|---|
| | Characteristics of Meter-in/ Meter-out | Characteristics of Objective Load |
| 1 | Meter-in/Meter-out both throttle valve | Without any particular setting of the acceleration/deceleration curve shockless acceleration/deceleration is carried out depending on the relation of the load characteristics and the supply side pressure. |
| 2 | Same as above, where Meter-in throttle is set larger than Meter-out throttle | Most preferred control method. The acceleration is carried out initially under meter-in control then it is switched over automatically to meter-out control. Deceleration is carried out under meter-out control. Applicable to either large loads or large inertier. |
| 3 | Same as above, where meter-in throttle is set smaller than meter-out throttle | Due to throttle characteristics, this method is used where the pressure rise on the meter-in side should be minimized during deceleration. Care should be taken lest the supply side becomes vacume during the deceleration. Not very applicable for use with counter load. An improved deceleration efficiency may be achieved by placing anti-cavitation valves in the pilot circuit. |
| 4 | Meter-in/Meter-out both pressure-compensating flow control valves | This is used to carry out acceleration/deceleration according to a specific acceleration/deceleration curve, which may be set by adjusting parts of the acceleration/deceleration device. |
| 5 | Same as above, where meter-in is set larger than meter-out | Same as 2, but both acceleration and and decleration are carried out under meter-out control because of the use pressure compensating valves. |
| 6 | Same as above, where meter-in is set smaller than meter-out | The setting is not preferred. It requires anti-cavitation measures. This method is used to change speed during normal and reverse revolutions of a counter load. In this case, however, flow control valves for meter-out control use of normal load are excluded. |

Since both of these application examples are shown for motor circuits, however, the opening areas of the main orifices 81, 82 are assumed to change identically. In the tables, "Sol." represents each solenoid of solenoid valves 113, 123, while "meter-in" and "meter-out" rep- Table 1

| Working Conditions | | |
|---|---|---|
| | Working Condition of Sol | Working Condition of Actuator |
| Main Orifice without Initial Opening | Sol. L or Sol. R On; Sol. S Off | Very low speed starting, normal or reverse revolution |
| | Sol. L or Sol. R On → Sol. S On | Very low speed → Acceleration |
| | Sol. L or Sol. R, and Sol. S, On | Acceleration starting, normal or reverse revolution |
| | Sol. L or Sol. R, and Sol. S, On; then Sol. S Off | High speed → Deceleration → Very low speed |
| | Sol. L and Sol. R Off | Stop |
| | Sol. S On → Sol. L or Sol. R On | Full speed starting |
| | Sol. L or Sol. R, and Sol. S, On; then Sol. L or Sol. R Off | Quick stopping |
| Main Orifice with Initial Opening | Sol. or Sol. R On, Sol S Off | Low speed starting |
| | Sol. L or Sol. R On → Sol. S. On | Low speed → Acceleration |
| | Sol. L or Sol. R, and Sol. S, On | Acceleration starting from low speed |
| | Sol. L or Sol. R, and Sol. S, On; then Sol. S Off | High speed → Deceleration → Low speed |
| | Sol. L and Sol. R Off | Stopping |
| | Sol. S On → Sol. L or Sol. R On | Full speed starting |
| | Sol. L or Sol. R, and Sol. S, On; then Sol. L or Sol. R Off | Quick stopping |

resent flow rate adjusting valve 115 and flow rate adjusting valves 119, 120, respectively.

From the above explanation of the application of acceleration/deceleration devices of FIGS. 17 and 18, it will be realized that shockless acceleration/deceleration of the load may be achieved, that speed control of the load may be achieved according to a proper acceleration/deceleration curve set beforehand despite changing temperature and pressure of the actuating fluid if pressure-compensating flow control valve are employed as the flow adjusting valves 115, 119, 120, that since open circuits are employed, simultaneous operations may be achieved in parallel circuits for acceleration/deceleration purposes, and that great flexibility may be provided for the control specifications if they are applied in combination with other circuit specifications.

Depending on the conditions of application, however, meter-out is sometimes made during the acceleration. When meter-out is carried out during acceleration, a pressure resistance occurs on the discharge side and the differential pressure between pressures at the supply and the discharge sides creates an effective pressure producing acceleration. Thus, the said differential pressure, and eventually the acceleration efficiency, become lowered depending on characteristics of the flow rate adjusting valves 115, 119, 120. Of course, if pressure-compensating flow control valves are used as the flow rate adjusting valves 115, 119, 120 as stated in 5 of Table 2, and if the opening area of flow rate adjusting valves 119, 120 is set to be smaller than that of flow rate adjusting valve 115 so as always to effect meter-out control during acceleration, the flow rate adjusting valve 115 for meter-in use will essentially not operate and the pressure of the supply side will increase with increasing pressure of the discharge side, and the effective differential pressure may be used to produce acceleration. During deceleration, however, since it is carried out originally under meter-out control, the supply side pressure will increase up to the maximum value set by a main relief valve 98. Thus, there is a danger of increasing the discharge side pressure considerably and the deceleration efficiency as determined by the differential pressure between the two will become rather low.

Figure 19:
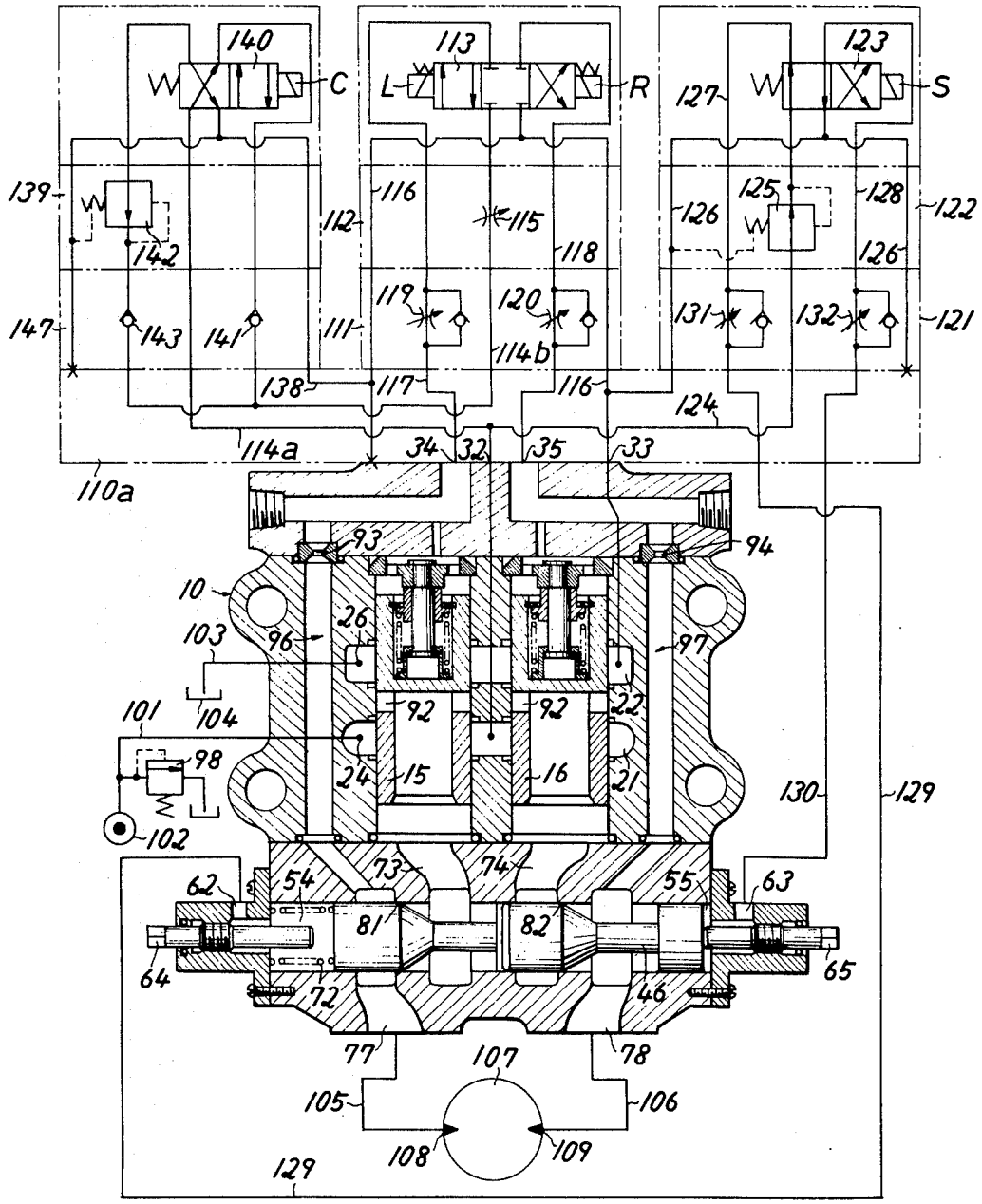
FIG. 19 represents a circuit diagram where a means for reducing the supply side pressure during the deceleration is combined with the acceleration/deceleration device of FIG. 17.

The application example of FIG. 19 shows a typical acceleration/deceleration device provided with a means for improving efficiency during deceleration. Namely, a manifold plate 110 is formed by dividing the supply side pilot flow passage into two passages 114*a,* 114*b* and by forming a branch passage 138 from the discharge side pilot passage 116. A valve assembly 147 for check valve use, a valve assembly 139 for pressure adjusting valve use and a 4-port 3-position solenoid valve 140 are attached in layers thereon so as to connect passage 114*a* of the said manifold plate 110*a* and branch passage 138 with two ports of the solenoid valve 140 and so as to connect the remaining ports of the solenoid valve 140 with passage 114*b* of the said manifold plate 110*a* through check valve 141 and through pressure-reducing valve 142 and check valve 143, respectively. These stated points are different from the case shown in FIG. 17. According to this device, a solenoid C of a solenoid valve 140 is inactivated as shown in the figure during acceleration and the supply side pilot flow of the hydraulic actuating fluid proceeds from supply port 32 of the amplification valve 10 towards solenoid valve 113 through passage 114*a* — solenoid valve 140 — check valve 114 — passage 114*b.* The control process during acceleration, therefore, is not at all different from that of the application example of FIG. 17. Nevertheless, during deceleration, when solenoid valve 140 is swtiched over to the right position by activating its solenoid C, the supply side pilot flow proceeds through passage 114*a* and solenoid valve 140 and, after its pressure is lowered by means of pressure-reducing valve 142, it is sent to the passage 114*b* side through check valve 143. Thus, the supply side pressure is kept low during deceleration and deceleration efficiency as determined by the differential pressure between the supply side pressure and the discharge side pressure may be improved.

Figure 20:
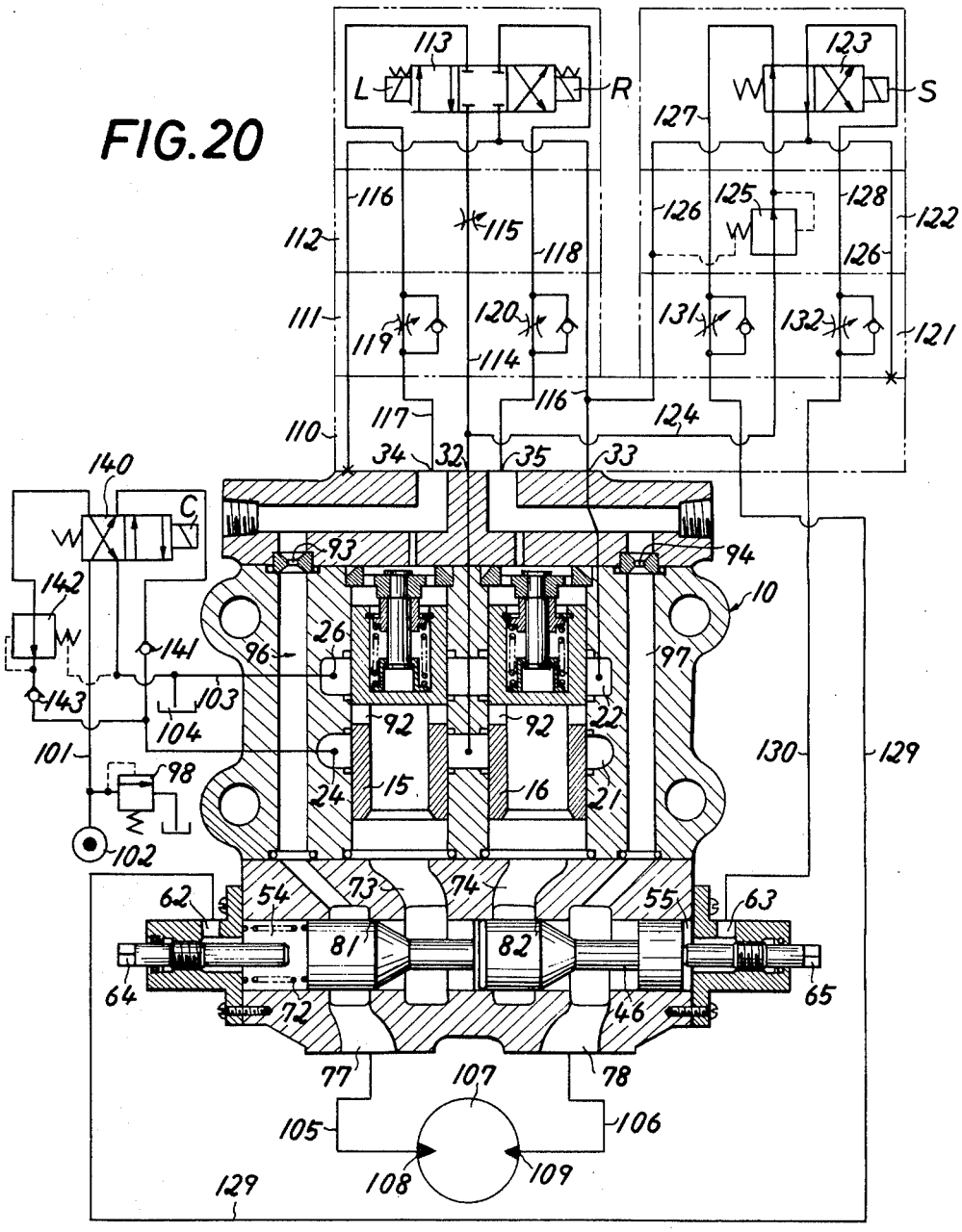
FIG. 20 represents a circuit diagram showing another application pattern of the same.

In the said application example of FIG. 19, the pressure of the supply side pilot flow is reduced during deceleration so as to make parallel actuation possible. In the case where only single actuation is used, however, it will be more effective, in view of heat and power losses, to install the said pressure-reducing means in a duct 101 as seen in the application example of FIG. 20.

Figure 21:
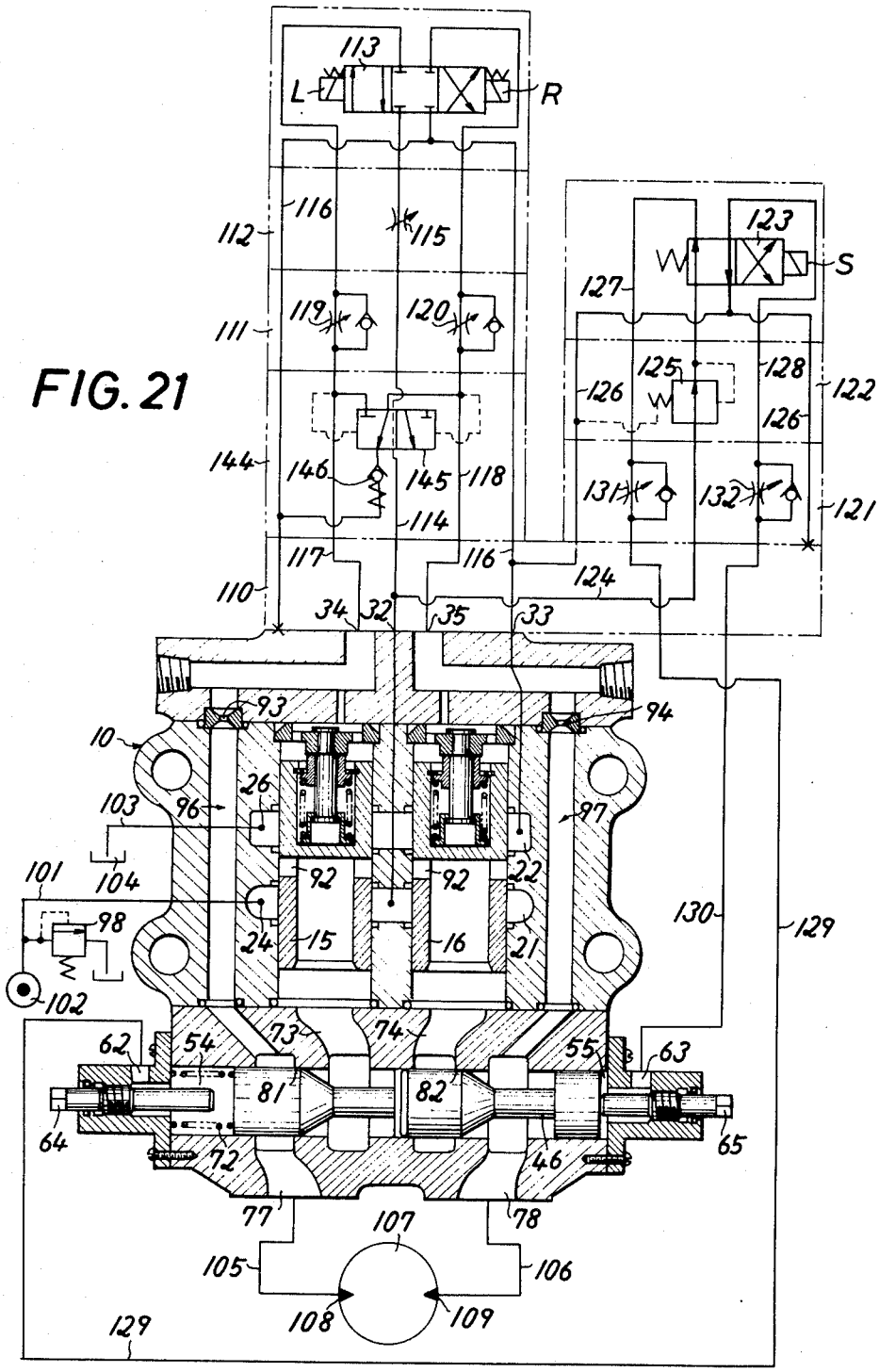
FIG. 21 represents a circuit diagram where a means for automatically reducing the pressure of the supply side during the deceleration is combined with the same.

If the application example of FIG. 21, a valve assembly 144 for switching use is added to that of FIG. 17, being installed between the manifold plate 110 and the valve assembly 111 for flow rate adjusting valve use. It functions to detect the pilot flow pressure of both the supply and the discharge sides and to return the pilot flow found to be the lower partly to the reservoir 104 side. Namely, as soon as the actuator 107 starts operation, a switch valve 145 of the valve assembly 144 is tripped by the supply side pilot flow and switches over to a position such that the discharge side pilot flow partly returns to passage 116 of the discharge side through low pressure relief valve 146. Following the starting of the actuator 107 under the said condition, the acceleration process is carried out in a manner such that the meter-in flow always be controlled. In the deceleration process, the supply side flow rate to the actuator 107 decreases due to the reduced opening area of main orifices 81, 82, resulting in a rapid fall in the presence of that side. Thus, switch vale 145 is switched over to the opposite position that returns the supply side pilot flow partly to the discharge side passage 116 through the low pressure relief valve 146. Upon starting the deceleration process therefore, the actuator 107 is deceleration under the meter-out control. Under the said condition, the supply side pressure is kept low due to the relation between the flow rate adjusting valve 115 for meter-in use and the switch valve 145, irrespective of the pressure of the hydraulic source 102. The influence of the pressure from the hydraulic source 102 is thus avoided during deceleration, and the deceleration process is carried out with the highest efficiency.

It may be added that the abovementioned mechanism may also be used as a counter circuit without hunting occurring. The above explanations of each application example were for a motor circuit where the inflow and the outflow of load are identical. If there are differences in area relating to cylinders, etc., the combination of flow rate adjusting valves 115, 119, 120 and the change ratio of main orifices 81, 82 formed at tapered parts 70, 71 of valve spool 46 should be modified appropriately. In characteristics, the purpose and method should be in accordance with those previously described.

Although we have explained the preferred application examplesof the present invention, it is clear that a number of modifications may be practiced without deviating from the principles of the present invention. It is hoped, therefore that all modifications substantially belonging to the category of the present invention will be included in the scope of the following patent claim.

What is claimed is:

1. An acceleration/deceleration system of the open-circuit type, comprising a fluid motor having two motor ports;

a fluid pressure source;

a fluid reservoir;

supply conduit means connecting said source to said motor;

discharge conduit means connecting said motor to said reservoir;

an amplification vavle assembly interposed in both of said conduit means and comprising a valve body having two parallel cylindrical valve chambers having a first and a second axial end;

port means in said valve body including a first and a second external port respectively communicating with said source and said reservoir as well as with the respective chambers;

a plurality of internal ports in said valve body intercommunicating said chambers;

third and fourth external ports in said valve body each communicating said axial axial end of each of said chambers with a respective one of said motor ports;

hollow fluid pressure responsive first supply and exhaust valve spools axially slidable in the respective chambers relative to said internal ports between a neutral position in which they block the fluid flow through said chambers and an operating position in which they permit supply and exhaust fluid flow therethrough;

a pair of pilot flow passages in said valve body each having one end communicating with said first end of one of said chambers and also having another end connected with a respective external port;

a limiting orifice member interposed in each of said pilot flow passages;

a valve passage in said valve body interconnecting each of said second axial ends with a respective pilot passage adjacent a respective external port;

and pilot generated spool valve means including spool valves slidably interposed in said valve passage, a spool valve means control pilot circuit, and a valve spool control circuit, being operative for supplying fluid to a respective pilot flow passage and to the first end of a respective chamber to act on the respective pressure responsive valve spool for controlling the displacement of said valve spools in said chambers in dependence upon a pressure drop occurring between fluid flows passing said limiting orifice members in said pilot flow passages.

2. A system as defined in claim 1, and said valve spool control circuit including a solenoid valve which controls the flow in said pilot passages, first flow rate adjusting valve means for meter-in control and second flow rate adjusting valve means for meter-out control.

3. A system as defined in claim 2, and said spool valve means control pilot circuit including an additional solenoid valve operative for controlling movement of said spool valve means, and low rate adjusting valves for meter-out control and incorporated in passages leading to said additional solenoid valve.

4. A system as defined in claim 3, wherein said valve spool control circuit and said spool valve means control circuit are mounted at different levels on a manifold plate attached to said amplification valve assembly.

5. A system as defined in claim 2, wherein said valve spool control circuit comprises means installed in one of said pilot passages which communicates with said solenoid valve and operative for reducing the pressure in said passage during deceleration.

6. A system as defined in claim 1, and further comprising means for reducing the supply pressure during deceleration.

7. A system as defined in claim 1, and further comprising means for detecting the differential pressure between the pilot flows and for automatically returning the pilot flow having the lower pressure via a low-pressure relief valve to the reservoir.

* * * * *